US009461373B2

(12) United States Patent
Hoppmann et al.

(10) Patent No.: US 9,461,373 B2
(45) Date of Patent: Oct. 4, 2016

(54) TERMINAL CLAMP

(71) Applicant: PHOENIX CONTACT GMBH & CO. KG, Blomberg (DE)

(72) Inventors: Ralph Hoppmann, Bad Oeynhausen (DE); Martin Gebhardt, Porta Westfalica (DE); Detlef Toeberich, Luegde (DE); Holger Steinhage, Steinheim (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/759,437

(22) PCT Filed: Jan. 13, 2014

(86) PCT No.: PCT/EP2014/050493
§ 371 (c)(1),
(2) Date: Jul. 7, 2015

(87) PCT Pub. No.: WO2014/111346
PCT Pub. Date: Jul. 24, 2014

(65) Prior Publication Data

US 2015/0357726 A1 Dec. 10, 2015

(30) Foreign Application Priority Data

Jan. 17, 2013 (DE) ..... 10 2013 000 713

(51) Int. Cl.

| | |
|---|---|
| ***H01R 11/20*** | (2006.01) |
| ***H01R 4/38*** | (2006.01) |
| *H01R 4/48* | (2006.01) |
| *H01R 9/26* | (2006.01) |

(52) U.S. Cl.
CPC ..... *H01R 4/38* (2013.01); *H01R 4/4818* (2013.01); *H01R 4/48* (2013.01); *H01R 9/2608* (2013.01)

(58) Field of Classification Search
USPC ..... 439/436–441, 828, 852
See application file for complete search history.

(56) References Cited

U.S. PATENT DOCUMENTS 5,393,932 A * 2/1995 Young ..... H01Q 1/244 174/84 R

FOREIGN PATENT DOCUMENTS

| | | | | |
|---|---|---|---|---|
| DE | 2632063 | * | 7/1978 | ..... H01R 4/48 |
| DE | 3503370 | * | 8/1986 | ..... H01R 4/4818 |
| DE | 10018352 C1 | | 9/2001 | |
| EP | 1248318 A2 | | 10/2002 | |
| FR | 2118477 A5 | | 7/1972 | |
| GB | 1373945 A | | 11/1974 | |
| KR | 20070104221 | * | 5/2007 | ..... H01R 4/4818 |

* cited by examiner

*Primary Examiner* — Tho D Ta
(74) *Attorney, Agent, or Firm* — Leydig, Voit & Mayer, Ltd.

(57) ABSTRACT

A terminal clamp is described. The terminal clamp includes a housing, a clamp pocket arranged in the housing into which a conductor to be clamped can be inserted, the clamp pocket having a base wall, and two side walls which are opposite each other, which extend away from the base wall, and which form a conductor guide channel, the conductor guide channel having, at least in regions in the longitudinal direction thereof, a cross-section which continually narrows towards the base wall, and at least one clamping spring protruding into the clamp pocket for clamping the inserted conductor in the clamp pocket.

8 Claims, 4 Drawing Sheets

TERMINAL CLAMP

CROSS REFERENCE TO RELATED APPLICATIONS

This application is a U.S. National Phase application under 35 U.S.C. §371 of International Application No. PCT/EP2014/050493 (WO 2014/111346 A1), filed on Jan. 13, 2014, and claims benefit to German Patent Application No. DE 10 2013 000 713.5, filed Jan. 17, 2013.

FIELD

The invention relates to a terminal clamp, in particular to an electrical terminal clamp for conductors having a large cross-sectional area.

BACKGROUND

The number of terminal clamps which are also suitable for clamping conductors having a large conductor cross-section, in particular a conductor cross-section or conductor cross-sectional area >35 $mm^2$, is small to date. The known terminal clamps for clamping conductors having a large cross-sectional area usually have a screw connection. Furthermore, a combination of a screw connection and a spring connection is also known, in which a spring is tensioned by a screw mechanism and acts similarly to a clamping sleeve of a screw terminal and pulls the conductor to be clamped against a busbar. All of these terminals usually press the conductor to be clamped against a flat busbar. In the process, a displacement of the conductor to be clamped can easily occur, as a result of which a secure clamping of the conductor onto the flat busbar can no longer be ensured.

SUMMARY

In an embodiment, the present invention provides a terminal clamp that includes: a housing; a clamp pocket arranged in the housing into which a conductor to be clamped can be inserted, the clamp pocket having a base wall, and two side walls which are opposite each other, which extend away from the base wall, and which form a conductor guide channel, the conductor guide channel having, at least in regions in the longitudinal direction thereof, a cross-section which continually narrows towards the base wall; and at least one clamping spring protruding into the clamp pocket for clamping the conductor inserted in the clamp pocket.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
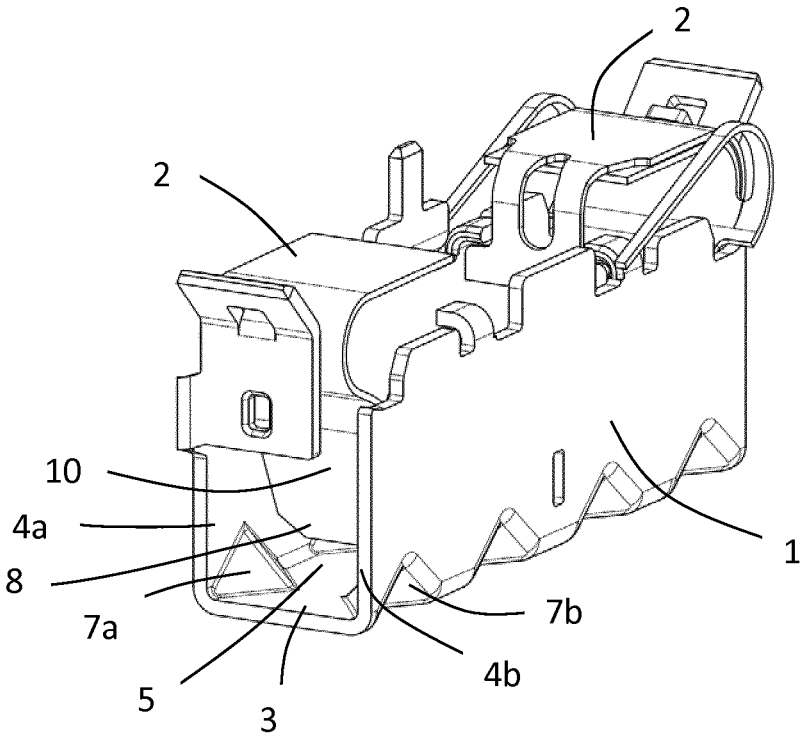
FIG. 1 is a schematic perspective view of a terminal clamp without a housing according to a first embodiment of the invention.

An object of an embodiment of the invention is to provide a terminal clamp in which an undesirable displacement of the conductor inside the terminal clamp can be prevented and therefore a secure clamping of the conductor can be ensured.

In the case of a terminal clamp of the kind described in more detail at the outset, the object is achieved according to the invention in that the terminal clamp has a housing, a clamp pocket arranged in the housing into which a conductor to be clamped can be inserted, and at least one clamping spring protruding into the clamp pocket for clamping the inserted conductor in the clamp pocket, the clamp pocket having a base wall and two side walls which are opposite each other and extend away from the base wall and which form a conductor guide channel, the conductor guide channel having, at least in regions in the longitudinal direction thereof, a cross-section which continually narrows towards the base wall.

A terminal clamp according to an embodiment of the invention is characterised in that the busbar is now constructed in the form of a clamp pocket which, by means of a base wall and by means of two side walls extending away laterally from the base wall, forms a conductor guide channel in which a defined guiding of the conductor is enabled and in particular an undesirable lateral displacement of the conductor out of a clamping position can be prevented. Furthermore, the conductor guide channel is characterised in that it has, at least in regions in the longitudinal direction thereof, a cross-section which continually narrows towards the base wall. The continually narrowing cross-section forms a centering for the conductor to be clamped in the conductor guide channel so that the conductor can be held such that it cannot slip in the conductor guide channel. The narrowing cross-section does not extend along the entire height of the clamp pocket but rather is constructed in the lower region of the clamp pocket where the conductor is inserted. In the upper region of the clamp pocket, where the clamping spring is also positioned inside the clamp pocket, the side walls which are opposite each other are arranged extending parallel to one another. In the process, the continually narrowing cross-section of the conductor guide channel is constructed such that the movement of the clamping leg of the clamping spring which is constructed as a leg spring is not restricted by the narrowing cross-section. Furthermore, the terminal clamp is characterised by a compact design, in which conductors having different conductor cross-sections can be connected.

The narrowing cross-section of the conductor guide channel is formed by a V-shape or a combination of a U-shape and a V-shape. The narrowing cross-section is constructed in that the two side walls each have at least one bevel, which is convergent relative to the bevel of the opposite side wall. In the case of a combination of a U-shape and a V-shape, the bevels opposite each other of the two side walls do not abut one another in the region of the base wall of the clamp pocket but rather they are spaced apart from one another even in the region of the base wall so that the base wall between the two bevels opposite each other of the side walls is even and flat; however, the width of the base wall opposite regions where the two side walls extend parallel to one another is reduced. In contrast, in the case of the V-shape the two bevels of the side walls opposite each other abut one another in the region of the base wall so that the width of the base wall here is reduced to a minimum.

In the process, the continually narrowing cross-section of the conductor guide channel can be formed by at least two indentations which are opposite each other and formed in a transitional region between a side wall and the base wall. The indentations are formed towards the interior of the conductor guide channel. An indentation extends along a region of each side wall, adjacent to the base wall, and a region of the base wall. The indentations can, for example, be triangular or be formed as a concavity in the form of a spherical portion. More than one indentation can also be formed for each side wall, the indentations of a side wall then being spaced apart from one another, the cross-section of the conductor guide channel not being narrowed in the region between two indentations formed in a side wall but rather having a rectangular cross-section so that in the region of the rectangular cross-section, the free end of the clamping spring can move freely without touching one of the indentations.

Alternatively to the construction of the narrowing cross-section by means of indentations, it is possible, furthermore, for the continually narrowing cross-section of the conductor guide channel to extend along the entire length of the conductor guide channel, the side walls each having a side wall portion adjacent to the base wall, which is inclined towards the base wall, the side wall portions of the side walls adjacent to the base wall having at least two recesses opposite each other in which a free end of a clamping leg of the clamping spring can be inserted. If the continually narrowing cross-section of the conductor guide channel extends along the whole length of the conductor guide channel, slipping of the conductor inside the conductor guide channel can be reliably prevented. Viewed towards the base wall, the side walls here are divided into two portions, the side wall portions near the base wall being slanted and inclined towards the base wall such that these side wall portions of the two side walls can taper towards one another. In contrast, the side wall portion of a side wall, which is remote from the base wall, is formed at an angle of substantially 90° to the base wall so that these side wall portions of the two side walls opposite each other are formed parallel to one another. In the pivot region of the clamping leg of the clamping spring, a recess is formed in each of the two inclined side wall portions, the recesses of the two side wall portions being opposite each other. The recesses make it possible for the free end of the clamping spring, when it is located near the base wall, as is particularly the case in the non-clamped state of the conductor or when clamping conductors having a very small cross-sectional area, to be inserted into it. As a result, the free end of the clamping spring does not have to be adjusted to the narrowing cross-sectional form of the conductor guide channel but rather can form an even surface. If the free end of the clamping leg were likewise to narrow or reduce towards the tip of the free end, a gap can form laterally between the conductor guide channel and the clamping leg into which individual strands of a conductor can insert themselves, and therefore a secure contacting can no longer be ensured. The free end of the clamping leg of the clamping spring therefore has a different cross-sectional shape here than the conductor guide channel. Alternatively to the recesses, at least one convexity can be formed on each of the side walls and can form the conductor guide channel in this region so as to be wide enough to make it possible for an even surface at the free end of the clamping leg of the clamping spring to be inserted into the convexities, so that the clamping spring can perform a pivoting movement unimpeded inside the conductor guide channel despite a narrowing cross-section constructed along the entire length of the conductor guide channel.

Furthermore, in order to facilitate an insertion of a conductor into the conductor guide channel and thus also into the terminal clamp, it is provided for a guide portion, which protrudes into a conductor insertion opening of the housing, to be arranged on the clamp pocket in front of the conductor guide channel in the conductor insertion direction, the guide portion having a narrowing cross-section. The narrowing cross-section of the guide portion can, for example, be formed in a V-shape or a combination of a U-shape and a V-shape.

The terminal clamp can be constructed as a terminal block which can be snapped onto a mounting rail, the housing having a snap-on foot for this purpose for fixing the terminal clamp on a mounting rail. The snap-on foot is formed integrally with the housing.

Figure 2:
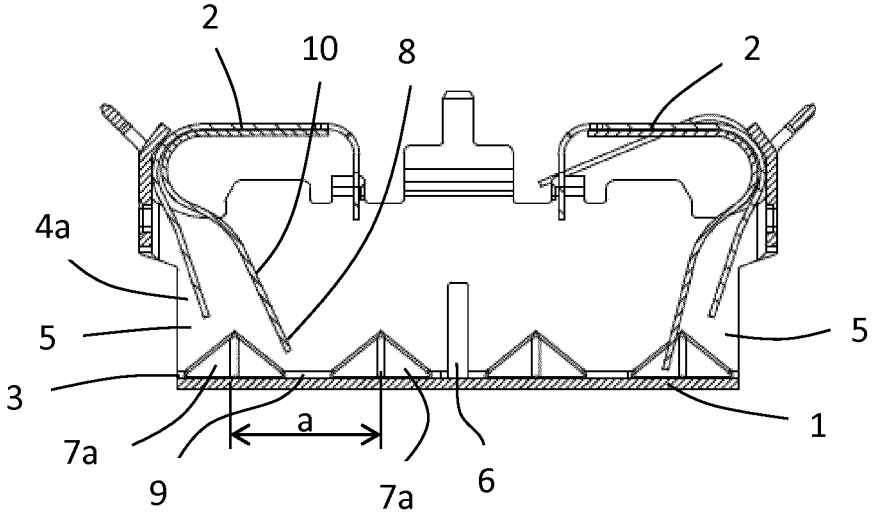
FIG. 2 is a schematic sectional view of the terminal clamp shown in FIG. 1.
Figure 8:
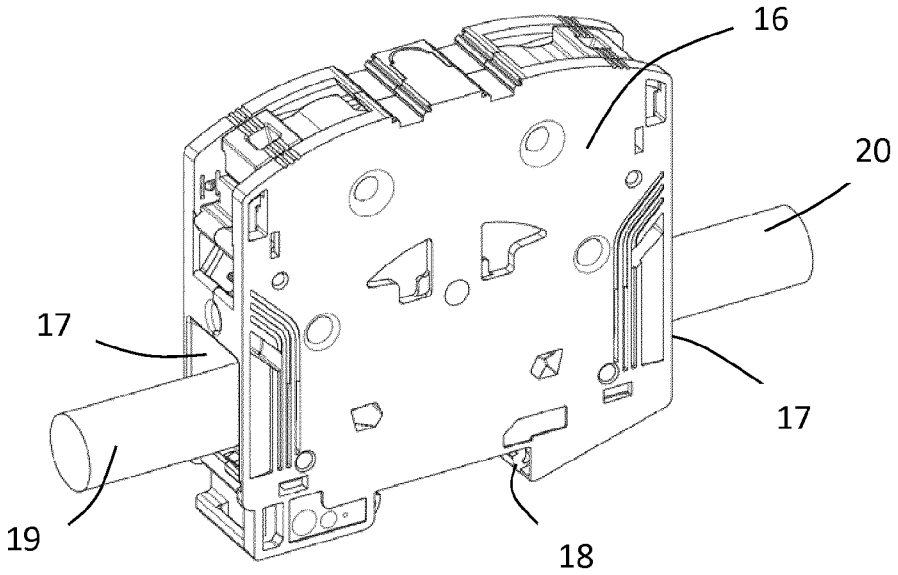
FIG. 8 is a schematic perspective view of the terminal clamp shown in FIG. 7 with two conductors inserted into the terminal clamp.

FIGS. 1 and 2 show a first embodiment of a terminal clamp having a clamp pocket 1, in which two clamping springs 2, which are constructed here as bundles of clamping springs consisting of a plurality of clamping spring elements, are formed. Two conductors 19, 20 can thus be clamped simultaneously here in one clamp pocket 1 using the two clamping springs 2, as shown in FIG. 8. The clamping springs 2 are constructed here as leg springs. Alternatively they can, however, also be constructed as cage springs.

The clamp pocket 1 has a base wall 3 and two side walls 4*a*, 4*b* which are opposite each other and extend away from the base wall 3. The base wall 3 and the two side walls 4*a*, 4*b* form a conductor guide channel 5, which extends along the entire length of the clamp pocket 1. An opening 6 is formed in the conductor guide channel 5, in which a dividing wall can be fixed which then extends inside the clamp pocket 1 starting from the base wall 3 upwards into the interior of the clamp pocket 1. The dividing wall divides the conductor guide channel 5 into two regions, into each of which one conductor 19, 20 can be inserted, it being possible to push the respective conductor 19, 20 so far into the conductor guide channel 5 that its end face abuts the dividing wall.

The conductor guide channel 5 has, in regions in the longitudinal direction thereof, a cross-section which continually narrows towards the base wall 3, the conductor guide channel 5 forming a combination of a U-shape and a V-shape in the region of the continually narrowing cross-section. This means that where the side walls 4*a*, 4*b* are connected to the base wall 3, the side walls 4*a*, 4*b* are still spaced apart, so that the cross-section of the conductor guide channel 5 is not formed so as to be acute, but rather has the shape of a longitudinal section through a truncated cone.

This is formed here by two indentations 7*a*, 7*b* formed opposite each other in a transitional region between a side wall 4*a*, 4*b* and the base wall 3. The indentations 7*a*, 7*b* are formed towards the interior of the conductor guide channel 5. An indentation 7*a*, 7*b* respectively extends along a region of the side wall 4*a*, 4*b* adjacent to the base wall 3, and a region of the base wall 3. The indentations 7*a*, 7*b* are triangular here. Two indentations 7*a*, 7*b* are formed per side wall 4*a*, 4*b*, the indentations 7*a*, 7*b* of a side wall 4*a*, 4*b* being spaced apart from one another in the longitudinal direction of the conductor guide channel 5. The distance a is of such a size that it forms a pivot region for the free end 8 of the clamping leg 10 of the clamping spring 2. In the region 9 between two indentations 7*a*, 7*b* formed on a side wall 4*a*, 4*b*, the cross-section of the conductor guide channel 5 is not narrowed but rather the conductor guide channel 5 has a rectangular cross-section so that in the region 9 of the rectangular cross-section of the conductor guide channel 5, the free end 8 of the clamping spring 2 can move freely without touching one of the indentations 7*a*, 7*b*. The free end 8 of the clamping leg 10 can thus "work" between two indentations 7*a*, 7*b* of a side wall 4*a*, 4*b*.

Figure 3:
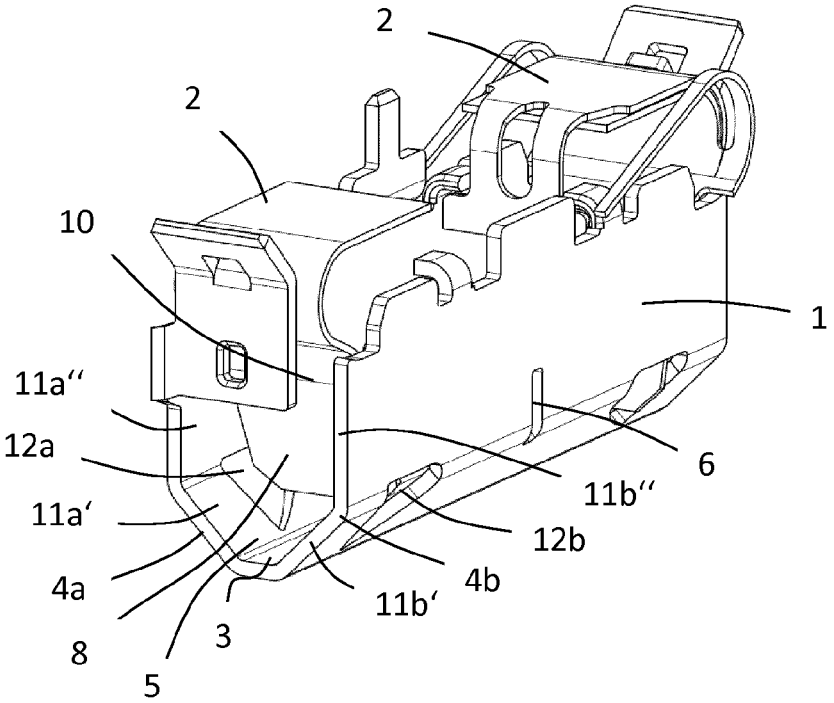
FIG. 3 is a schematic perspective view of a terminal clamp without a housing according to a second embodiment of the invention.
Figure 4:
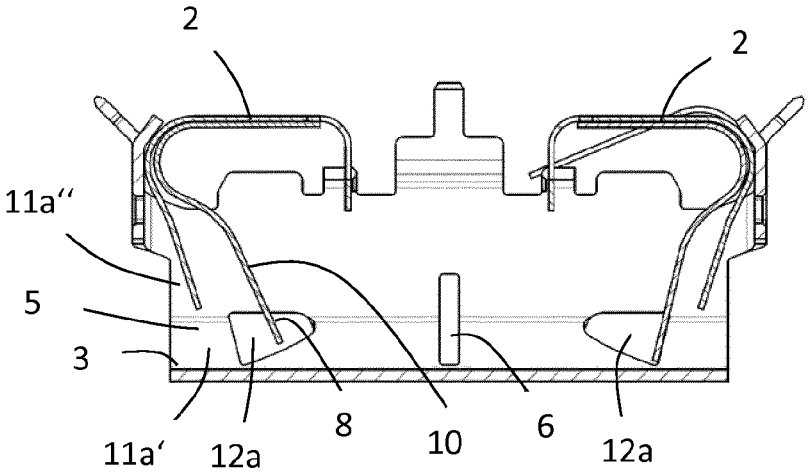
FIG. 4 is a schematic sectional view of the terminal clamp shown in FIG. 3.

In FIGS. 3 and 4 another possible embodiment is shown, in which the narrowing cross-section is not formed by indentations, but rather the continually narrowing cross-section of the conductor guide channel 5 extends along the entire length of the conductor guide channel 5. The side walls 4*a*, 4*b* here each have two side wall portions 11*a*', 11*a*", 11*b*', 11*b*". A first side wall portion 11*a*', 11*b*' adjoins the base wall 3 and is inclined towards the base wall 3. In contrast, a second side wall portion 11*a*", 11*b*" of a side wall 4*a*, 4*b*, which is remote from the base wall 3, is formed at an angle of substantially 90° to the base wall 3, so that these side wall portions 11*a*", 11*b*" of the two side walls 4*a*, 4*b* opposite each other are formed parallel to one another.

In the pivot region of the clamping leg 10 of the clamping spring 2, a recess 12*a*, 12*b* is formed in each of the two inclined side wall portions 11*a*', 11*b*', the recesses 12*a*, 12*b* of the two side wall portions 11*a*', 11*b*' being opposite one another. The recesses 12*a*, 12*b*, which are substantially triangular here, make it possible for the free end 8 of the clamping spring 10, when it is located near the base wall 3, which is particularly the case in a non-clamped state of the conductor or when clamping conductors having a very small cross-section area, to be inserted into it, as shown in FIG. 4.

Figure 5:
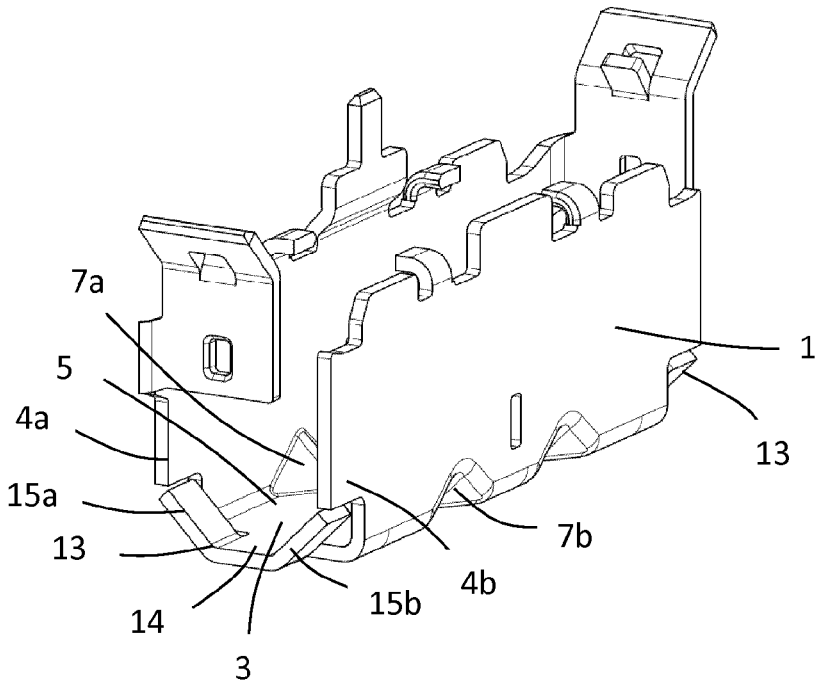
FIG. 5 is a schematic perspective view of a terminal clamp without a housing according to a third embodiment of the invention.
Figure 6:
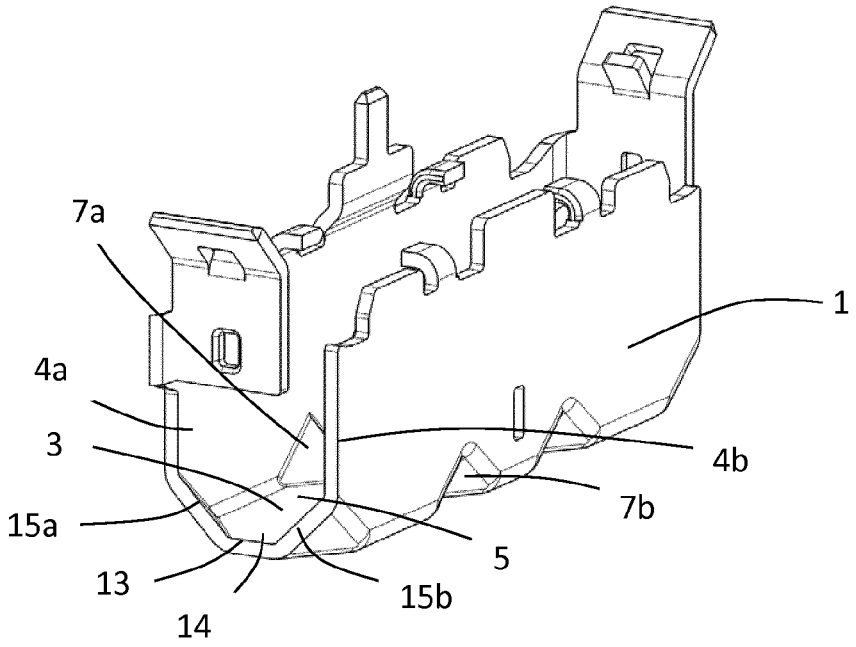
FIG. 6 is a schematic perspective view of a terminal clamp without a housing according to a fourth embodiment of the invention.

In FIGS. 5 and 6 two embodiments are shown in which a guide portion 13 is formed on the clamp pocket 1 in front of the conductor guide channel 5 in the conductor insertion direction, the guide portion 13 likewise having a narrowing cross-section.

In the embodiment shown in FIG. 5, the guide portion 13 is formed integrally with the base wall 3 of the clamp pocket 1. In contrast, the side walls 4*a*, 4*b* are separate from the guide portion 13. The guide portion 13 has a base 14 which is in a plane with the base wall 3 of the clamp pocket 1. Two side faces 15*a*, 15*b*, which are opposite each other, adjoin the base 14 and are offset relative to the base 14 such that the guide portion 13 also has a narrowing cross-section which is formed by a combination of a U-shape and a V-shape.

As a result of the construction of a guide portion 13, the number of indentations 7*a*, 7*b* per side wall 4*a*, 4*b* can be reduced to one indentation 7*b*, as shown in the embodiment shown in FIG. 5.

In the embodiment shown in FIG. 6, the base 14 of the guide portion 13 is formed integrally with the base wall 3 of the clamp pocket 1 and also the offset side faces 15*a*, 15*b* are formed integrally with the side walls 4*a*, 4*b* of the clamp pocket 1. A guide portion 13 here has the form of a half indentation. Here too, the number of indentations 7*a*, 7*b* per side wall 4*a*, 4*b* can be reduced to one indentation 7*b* as a result of the construction of a guide portion 13.

Figure 7:
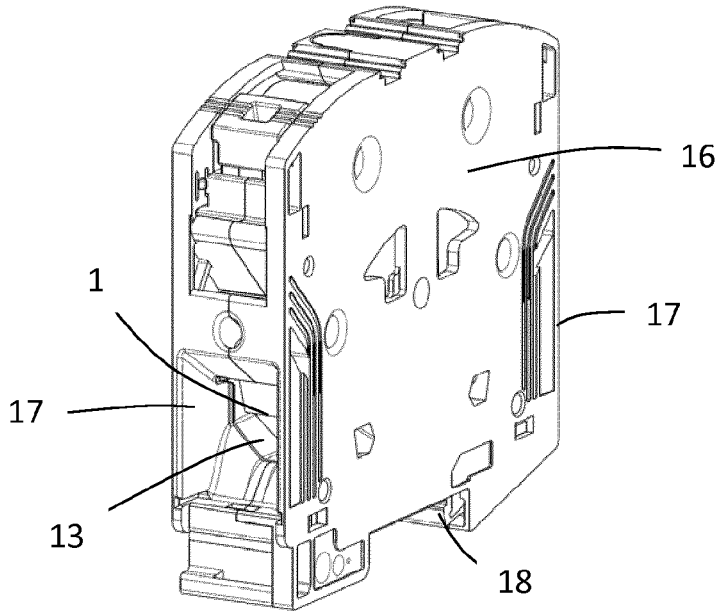
FIG. 7 is a schematic perspective view of a terminal clamp having a housing according to the invention.

FIG. 7 shows a terminal clamp having a housing 16, in which the clamp pocket 1 is arranged together with the clamping springs 2. The housing 16 here is disc shaped and has two conductor insertion openings 17 opposite each other, the guide portion 13 or the clamp pocket 1 itself protruding into the conductor insertion opening 16 in order to facilitate an insertion and thus also a clamping of a conductor 19, 20 in the terminal clamp.

Furthermore, the underside of the housing 16 has a snap-on foot 18, with which the housing 16 and thus the terminal clamp can be snapped onto a mounting rail. The terminal clamp is therefore formed as a terminal block here. A use of the terminal clamp other than as a terminal block is, however, also possible.

FIG. 8 shows an embodiment in which two conductors 19, 20 are inserted into the terminal clamp and connected in that the respective clamping leg 8 of a clamping spring 2 presses a conductor 19, 20 against the base wall 3 of the clamp pocket 1, the base wall 3 of the clamp pocket 1 here having the function of a busbar.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Clamp pocket: 1
Clamping spring: 2
Base wall: 3
Side wall: 4*a*, 4*b*
Conductor guide channel: 5
Opening: 6
Indentation: 7*a*, 7*b*
Free end: 8
Region: 9
Clamping spring: 10
Side wall portion: 11*a*', 11*a*", 11*b*', 11*b*"
Recess: 12*a*, 12*b*

Guide portion: 13
Base: 14
Side face: 15*a*, 15*b*
Housing: 16
Conductor insertion opening: 17
Snap-on foot: 18
Conductor: 19
Conductor: 20

The invention claimed is:

1. A terminal clamp comprising:

a housing, a clamp pocket arranged in the housing into which a conductor to be clamped can be inserted, the clamp pocket having:

a base wall, and two side walls which are opposite each other, which extend away from the base wall, and which form a conductor guide channel, the conductor guide channel having, at least in regions in a longitudinal direction thereof, a cross-section which continually narrows towards the base wall, and at least one clamping spring protruding into the clamp pocket for clamping the conductor inserted in the clamp pocket, wherein the continually narrowing cross-section of the conductor guide channel is formed by at least two indentations which are opposite each other and which are formed in a transitional region between at least one side wall and the base wall.

2. The terminal clamp according to claim 1, wherein the continually narrowing cross-section of the conductor guide channel is formed in a V-shape or a combination of a U-shape and a V-shape.

3. The terminal clamp according to claim 1, wherein a guide portion protruding into a conductor guide opening of the housing is arranged on the clamp pocket in front of the conductor guide channel in a conductor insertion direction, the guide portion having a narrowing cross-section.

4. The terminal clamp according to claim 1, wherein the housing has a snap-on foot for fixing the terminal clamp to a mounting rail.

5. A terminal clamp comprising:

a housing, a clamp pocket arranged in the housing into which a conductor to be clamped can be inserted, the clamp pocket having:

a base wall, and two side walls which are opposite each other, which extend away from the base wall, and which form a conductor guide channel, the conductor guide channel having, at least in regions in a longitudinal direction thereof, a cross-section which continually narrows towards the base wall, and at least one clamping spring protruding into the clamp pocket for clamping the conductor inserted in the clamp pocket, wherein the continually narrowing cross-section of the conductor guide channel extends along an entire length of the conductor guide channel, wherein the side walls each have a side wall portion which is adjacent to the base wall and which is formed inclined towards the base wall, the side wall portions of the side walls adjacent to the base wall having at least two recesses opposite each other in which a free end of a clamping leg of the clamping spring can be inserted.

6. The terminal clamp according to claim 5, wherein the continually narrowing cross-section of the conductor guide channel is formed in a V-shape or a combination of a U-shape and a V-shape.

7. The terminal clamp according to claim 5, wherein a guide portion protruding into a conductor guide opening of the housing is arranged on the clamp pocket in front of the conductor guide channel in a conductor insertion direction, the guide portion having a narrowing cross-section.

8. The terminal clamp according to claim 5, wherein the housing has a snap-on foot for fixing the terminal clamp to a mounting rail.

* * * * *